US010780455B1

(12) United States Patent
Heilbruner

(10) Patent No.: US 10,780,455 B1
(45) Date of Patent: Sep. 22, 2020

(54) CAULKING GUN

(71) Applicant: Yona Heilbruner, Kidron (IL)

(72) Inventor: Yona Heilbruner, Kidron (IL)

( * ) Notice: Subject to any disclaimer, the term of this patent is extended or adjusted under 35 U.S.C. 154(b) by 0 days.

(21) Appl. No.: 16/260,143

(22) Filed: Jan. 29, 2019

(51) Int. Cl.
*B05C 17/01* (2006.01)

(52) U.S. Cl.
CPC ..... *B05C 17/0103* (2013.01); *B05C 17/0133* (2013.01)

(58) Field of Classification Search
CPC . B05C 17/0103; B05C 17/0133; B05C 17/01; B05C 17/00
USPC ..... 222/386, 326
See application file for complete search history.

(56) References Cited

U.S. PATENT DOCUMENTS 1,770,473 A * 7/1930 Javins ..... A47K 5/1211 220/231
2,836,333 A * 5/1958 Woodel ..... B05C 17/00516 222/566
3,985,273 A 10/1976 Davis, Jr.
3,997,085 A * 12/1976 Lindquist ..... B05C 17/0123 222/326
4,258,866 A * 3/1981 Bergman ..... A23G 3/28 222/333
5,027,984 A * 7/1991 Gakhar ..... B05C 17/0103 222/326
5,076,473 A * 12/1991 Steiner ..... B05C 17/0103 222/327
5,104,005 A * 4/1992 Schneider, Jr. ... B05C 17/00553 222/137
5,161,715 A * 11/1992 Giannuzzi ..... B05C 17/00506 222/105
5,626,263 A * 5/1997 Lii ..... B05C 17/01 222/192
5,762,239 A * 6/1998 Cossette ..... B05C 17/00553 222/326
5,815,925 A * 10/1998 Chang ..... B05C 17/01 30/92
5,839,612 A * 11/1998 Burke ..... B05C 17/0103 222/333
6,155,463 A * 12/2000 Dentler ..... B05C 17/01 222/165
6,488,180 B1 * 12/2002 Bayat ..... B05C 17/00553 222/137

* cited by examiner

*Primary Examiner* — Benjamin R Shaw
(74) *Attorney, Agent, or Firm* — Mark M. Friedman

(57) ABSTRACT

A caulking gun, comprising: a cylindrical housing; a nut fixed to a rear wall of said housing; a screw threaded into said nut, said screw having a bit at one end thereof, and a bearing connected to the other end thereof; a caulking tube situated inside said housing between a front wall thereof and said bearing, and a stopper, for preventing said bearing from reaching to said rear wall of said housing and as a result being separated from each other; wherein said bit having a depression, for allowing connecting thereto a snap connector, and wherein said housing comprises flexible straps, for providing compact storage of said caulking gun, and wherein said nut is further welded to a second wall of said housing, for holding said screw steady such that its longitudinal axis coincides with the longitudinal axis of said housing.

9 Claims, 8 Drawing Sheets

CAULKING GUN

TECHNICAL FIELD

The present invention relates to the field of caulking material dispensers. More particularly, the invention relates to a caulking gun.

BACKGROUND ART

A caulking gun is referred to in the art as a dispenser of caulking material through a nozzle. "Caulking is both the processes and material (also called sealant) to seal joints or seams in various structures and some types of piping." (Wikipedia).

FIG. 1 pictorially illustrates a caulking gun, according to the prior art.

The caulking gun of the prior art is marked by reference numeral 12. It comprises a housing 18 in which is disposed a caulking tube 30 in a form of a cylinder having a nozzle 32. The housing comprises a ratchet mechanism 20, a handle 14 and a corresponding lever 16. By approaching lever 16 to handle 14, the ratchet mechanism advances a toothed rod 26, which pushes a plunger 24. The plunger pushes the piston 36 of the tube 30, which detaches from the tube's walls and enters into the tube cylinder. Thus, the bottom of the tube operates as a piston such that the caulking material (which is in a form of a paste) is pushed outside the tube, through nozzle 32.

One of the drawbacks of this structure is the fact that the dispensing of the caulking material is not continuous, but rather in beats, which of course does not suit some types of dispensing.

The prior art solves this obstacle by a device in which the ratchet mechanism is replaced by a motor which dispenses the caulking material in a continuous and constant dispensing operation. Nevertheless, such a caulking gun is cumbersome and not compact, since it combines two mechanisms, a motor and a battery, which also occupies a meaningful volume.

All the methods described above have not yet provided satisfactory solutions to the problem of a caulking gun adapted for the needs of a handyman.

It is an object of the present invention to provide a solution to the above-mentioned and other problems of the prior art.

Other objects and advantages of the invention will become apparent as the description proceeds.

SUMMARY OF THE INVENTION

A caulking gun, comprising:

a cylindrical housing (18);

a nut (46) fixed to a rear wall (56) of the housing;

a screw (44) threaded into the nut (46), the screw (44) having a bit (42) at one end thereof, and a bearing (48) connected to the other end thereof, a caulking tube (30) situated inside the housing (18) between a front wall (28) thereof and the bearing (48); and a stopper, for preventing the bearing (48) from reaching to the rear wall (56) of the housing (18) and as a result being separated from each other;

wherein the bit (42) having a depression (62), for allowing connecting thereto a snap connector, and wherein the nut (46) is further welded to a second wall (58) of the housing, for holding the screw steady such that its longitudinal axis coincides with the longitudinal axis of the housing, and wherein the housing comprises flexible straps (66) connecting the front wall to a back wall (28, 58) of the housing, for providing compact storage of the caulking gun.

According to one embodiment of the invention, the bit (42) is adapted to be used by an electric screwdriver.

According to one embodiment of the invention, the bit (42) is adapted to be used by an electric drill.

According to one embodiment of the invention, the bearing (48) is welded to the screw (44).

According to one embodiment of the invention, the stopper is in a form of a washer (50) welded to the screw (44).

According to another embodiment of the invention, the stopper is in a form of a tenon (52) disposed in an orthogonal hole to a longitudinal axis (60) of the screw (44).

According to yet another embodiment of the invention, the stopper is in a form of a pair of nuts (54) threaded on the screw (44) such that each of the nuts (54) applies a force on the other.

According to one embodiment of the invention, the bearing is covered by a cover, for preventing the material dispensed by the tube from entering into rotating parts of the bearing.

According to one embodiment of the invention, the housing further comprising a foldable handle, for preventing rotating of the caulking gun when being used.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

BRIEF DESCRIPTION OF THE DRAWINGS

Preferred embodiments, features, aspects and advantages of the present invention are described herein in conjunction with the following drawings.

Figure 5:
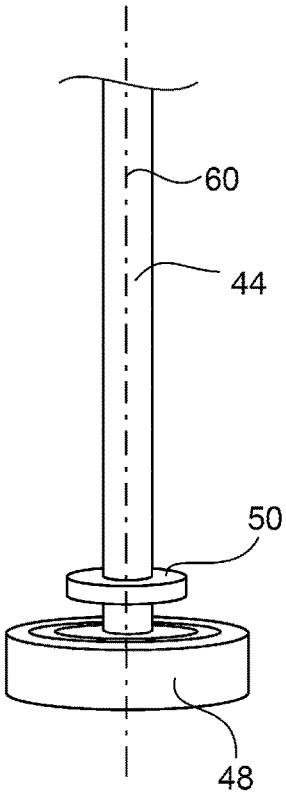
Figure 6:
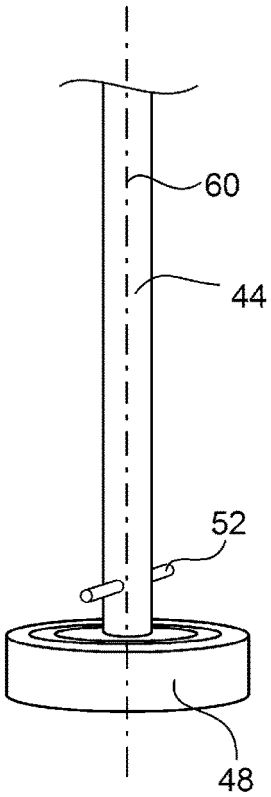
Figure 7:
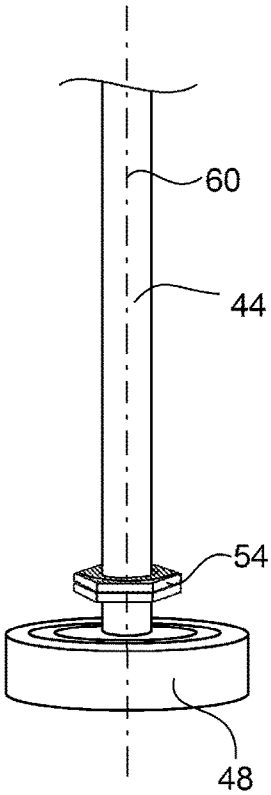

Each of FIGS. 5, 6 and 7 illustrates an example of a stopper for preventing the screw from separating from the bearing.

Figure 8:
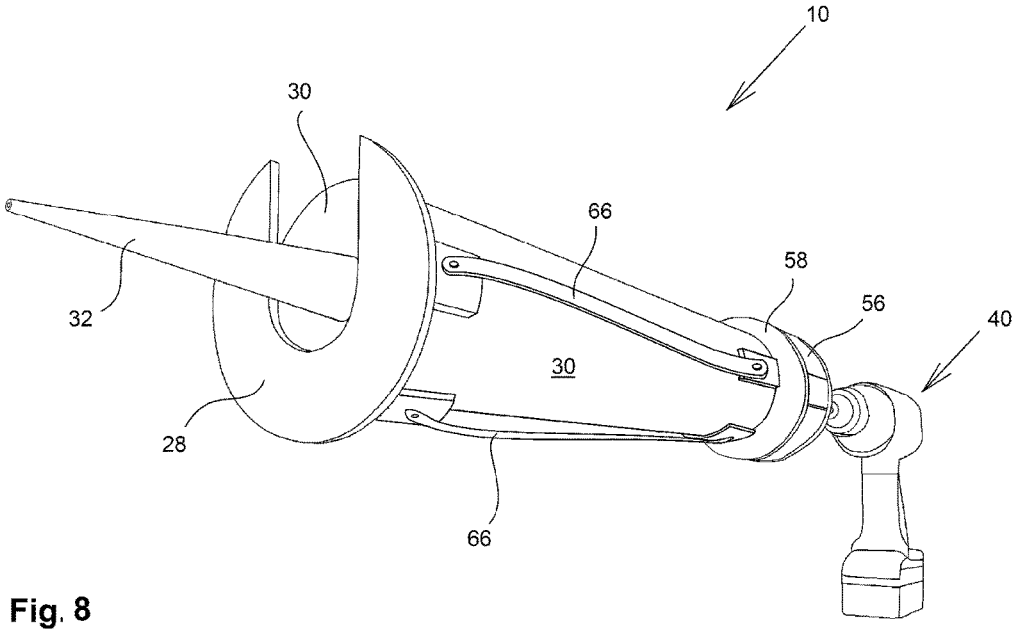

FIG. 8 schematically illustrates a caulking gun, according to another embodiment of the invention.

Figure 9:
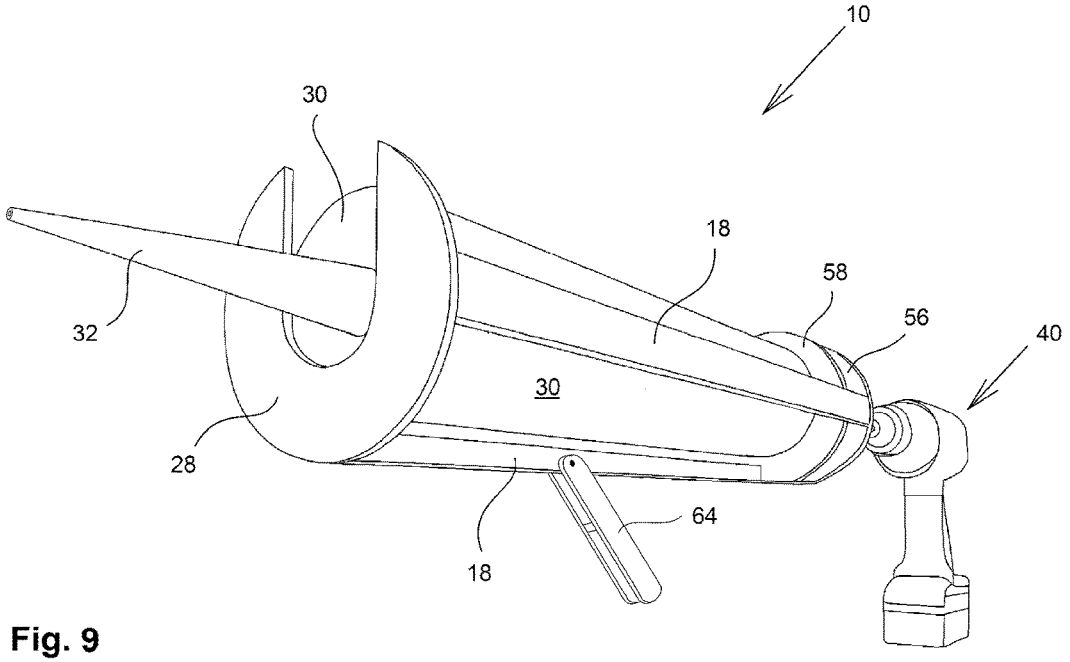

FIG. 9 schematically illustrates a caulking gun, according to yet another embodiment of the invention.

It should be understood that the drawings are not necessarily drawn to scale.

DESCRIPTION OF EMBODIMENTS

The present invention will be understood from the following detailed description of preferred embodiments ("best mode"), which are meant to be descriptive and not limiting. For the sake of brevity, some well-known features, methods, systems, procedures, components, circuits, and so on, are not described in detail.

Figure 1:
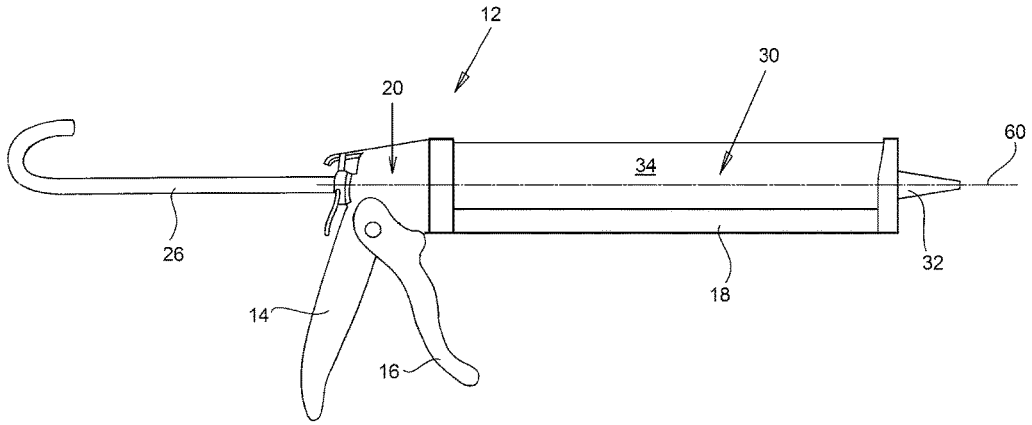
Fig. 1 PRIOR ART
FIG. 1 pictorially illustrates a caulking gun, according to the prior art.
Figure 2:
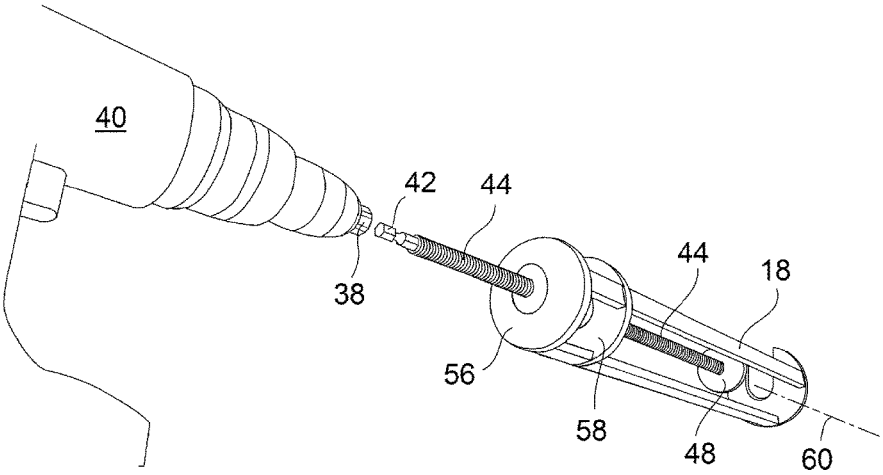
FIG. 2 schematically illustrates a caulking gun from a back side thereof, according to one embodiment of the invention.

FIG. 2 schematically illustrates a caulking gun from a back side thereof, according to one embodiment of the invention.

Figure 3A:
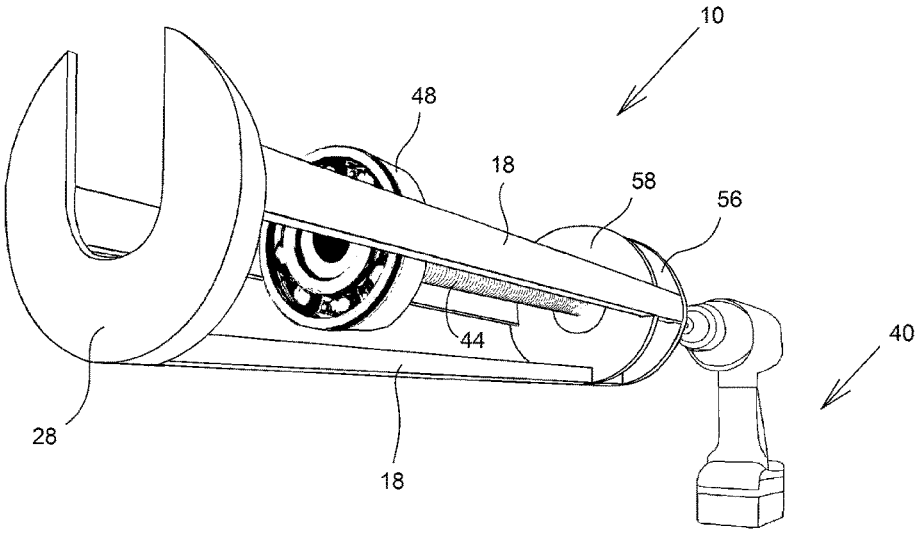
FIG. 3 schematically illustrates a caulking gun in which is disposed a tube, according to one embodiment of the invention.
Figure 3B:
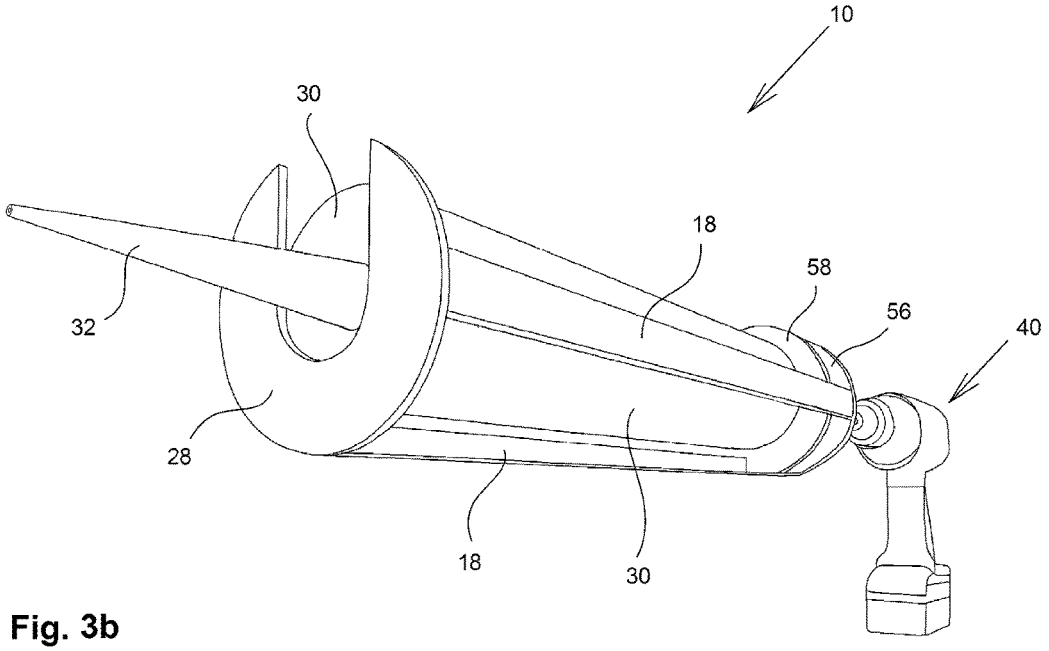

FIG. 3 schematically illustrates a caulking gun in which is disposed a tube, according to one embodiment of the invention.

Figure 4:
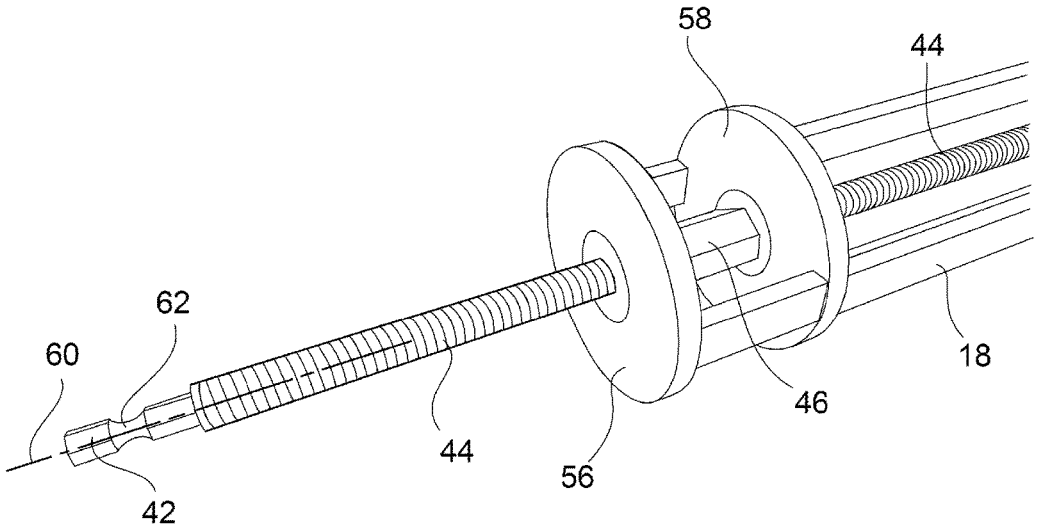
FIG. 4 is a zoomed view on a front side of a caulking gun, according to one embodiment of the invention.

FIG. 4 is a zoomed view on a front side of a caulking gun, according to one embodiment of the invention.

The caulking gun is marked herein by reference numeral 10. It comprises a housing 18 in which is fixed a nut 46, in which is threaded a corresponding screw 44. The screw 44 is situated longitudinally to the longitudinal axis 60 of housing 18. The length of screw 44 is about the length of the tube 30.

The external end (i.e., the end which is situated outside housing 18) of the screw 44 is a bit ("drill") 42 of a prismatic form.

The internal end (i.e., that is situated inside housing 18) of screw 44 is connected a rotational bearing 48, situated perpendicularly to the longitudinal axis (not illustrated) of the screw 44.

According to the Merriam Webster dictionary, the term "bearing" refers to a machine part in which another part (such as a journal or pin) turns or slides.

As such, the term "rotational bearing" refers herein to a machine part in which another part turns.

Since the screw 44 is threaded in the corresponding nut 46, upon rotating screw 44 it advances/retracts along the longitudinal axis of the screw, depending on the rotation direction. Since screw 44 is connected to the bearing 48, upon advancing the screw 44, the bearing pushes the bottom side of tube 30. Upon rotating the screw 44 in the opposite direction, the bearing 48 retracts, thereby allowing removing the empty tube from housing 18.

A caulking tube (illustrated in FIGS. 3 and 4) is disposed in the gap between the bearing 48 and the front wall 28 of housing 18.

The bottom side of the tube is in direct or indirect contact with the bearing 48. If the screw 44 were connected to a piston instead of a bearing, it would rotate the piston. However, using a rotational bearing diminishes the rotational power of the piston, and thereby the piston slides without rotating.

When the bearing 48 is pushed ahead by the screw 44, it pushes the bottom side of the caulking tube 30, thereby operating as a piston which pushes the content of the tube out of the tube via a nozzle.

An electric screwdriver 40 connects to the bit 42 of screw 44, thereby allowing the electric screwdriver 40 to be used as the power source for rotating the screw 44 (actually, the chuck 38 of the electrical screwdriver 40 grips the bit 42 of screw 44). Thus, the manual ratchet mechanism of the prior art is replaced by an electric screwdriver, thereby providing continuous operation, which does not require much physical effort from the user, in addition to the compactness of the caulking gun which is achieved due to the omission of the ratchet mechanism.

As mentioned above, screw 44 is connected at the end thereof to bearing 48. If the screw 44 mates with the hole in the center of the bearing by force, when the screw 44 is retracted in order to release space for placing therein a tube, the bearing 48 may meet the rear wall 56 of housing 18, and as a result be separated from the screw 44.

One solution is attaching a stopper to the screw, preferably about 3 mm from the bearing 48. Each of FIGS. 5, 6 and 7 illustrates an example of such a stopper. In FIG. 5 the stopper is in a form of a washer 50 welded to the screw 44; in FIG. 6 the stopper is in a form of a tenon 52 disposed in a orthogonal hole in the screw 44; and in FIG. 7 the stopper is in a form of a pair of nuts 54 tightly connected to each other on the screw 44. For the sake of brevity, the threads of screw 44 are not illustrated in FIGS. 5, 6 and 7.

Another way to prevent such separation is to weld the bearing 48 to screw 44.

Preferably, the bearing has a cover (not illustrated), for preventing the material dispensed by the tube from entering into the rotating parts (including balls) of the bearing 48.

It should be noted that from a mechanical point of view, the mechanism of the caulking gun 10 of the present invention is much simpler than the mechanism of the caulking gun 12 of the prior art, as it does not comprise a ratchet mechanism.

Furthermore, the present invention is advantageous over motorized caulking guns of the prior art, since it is more compact in storage. Actually, the caulking gun 10 of the present invention is in a form of a cylinder, and when the screw 44 is kept separated from the caulking gun 10, it is actually a cylinder slightly greater than the tube 30.

The power of the caulking gun 10 is an electric screwdriver, which is an essential tool for any handyman and householder.

Preferably, the housing is made of painted iron. The width of the screw 44 is preferably at a diameter of 0.5 cm.

FIG. 8 schematically illustrates a caulking gun, according to another embodiment of the invention.

According to this embodiment of the invention, the housing comprises flexible straps 66, which allow diminishing the space the caulking gun occupies when not in use. The straps may be made of leather, metal chain, and the like.

FIG. 9 schematically illustrates a caulking gun, according to yet another embodiment of the invention.

According to this embodiment of the invention, the caulking gun comprises a foldable handle 44, which allows preventing a rotation of the housing 18 when the caulking gun is being used.

In the figures and/or description herein, the following reference numerals (Reference Signs List) have been mentioned:

- numeral 10 denotes a caulking gun, according to one embodiment of the invention;
- numeral 12 denotes a caulking gun, according to the prior art;
- numeral 14 denotes a handle;
- numeral 16 denotes a lever;
- numeral 18 denotes a housing;
- numeral 20 denotes a ratchet mechanism;
- numeral 24 denotes a pushing plunger;
- numeral 26 denotes a toothed rod which is a part of the ratchet mechanism 20;
- numeral 28 denotes the front wall of housing 18;
- numeral 30 denotes a caulking tube;
- numeral 32 denotes a nozzle;
- numeral 34 denotes caulking material;
- numeral 36 denotes a piston of tube 30;
- numeral 38 denotes a chuck of an electrical screw driver;
- numeral 40 denotes an electric screwdriver, as an example of a rotating device having a chuck (38);
- numeral 42 denotes a bit ("drill") in a prismatic form;
- numeral 44 denotes an elongated screw the length of which is about the length of caulking tube;

numeral 46 denotes a nut correspondingly with screw 44;
numeral 48 denotes a rotational bearing;
numeral 50 denotes washer as an example of a stopper;
numeral 52 denotes a tenon as an example of a stopper;
numeral 54 denotes a pair of nuts threaded on the screw 44 such that they apply force on each other, as an example of a stopper;
numeral 56 denotes a rear wall of the housing 18;
numeral 58 denotes a wall of housing 18 wherein the nut 46 is disposed between this wall and the rear wall 56;
numeral 60 denotes a longitudinal axis of the housing 18 and screw 44;
numeral 62 denotes a depression in bit 42, for allowing a snap connection thereof,
numeral 64 denotes a foldable handle; and
numeral 66 denotes a flexible strap.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

The invention claimed is:

1. A caulking gun, comprising:
a cylindrical housing (18);
a nut (46) fixed to a rear wall (56) of said housing;
a screw (44) threaded into said nut (46), said screw (44) having a bit (42) at one end thereof, and a bearing (48) connected to the other end thereof;
a caulking tube (30) situated inside said housing (18) between a front wall (28) thereof and said bearing (48); and
a stopper, for preventing said bearing (48) from reaching to said rear wall (56) of said housing (18) and as a result being separated from each other;
wherein said bit (42) having a depression (62), for allowing connecting thereto a snap connector, and
wherein said nut (46) is further welded to a second wall (58) of said housing, for holding said screw steady such that its longitudinal axis coincides with the longitudinal axis of said housing, and
wherein said housing comprises flexible straps (66), each connecting said front wall (28) to a back wall (56, 58) of said housing, for providing compact storage of said caulking gun.

2. The caulking gun of claim 1, wherein said bit (42) is adapted to be used by an electric screwdriver.

3. The caulking gun of claim 1, wherein said bit (42) is adapted to be used by an electric drill.

4. The caulking gun of claim 1, wherein said bearing (48) is welded to said screw (44).

5. The caulking gun of claim 1, wherein said stopper is in a form of a washer (50) welded to said screw (44).

6. The caulking gun of claim 1, wherein said stopper is in a form of a tenon (52) disposed in an orthogonal hole to a longitudinal axis (60) of said screw (44).

7. The caulking gun of claim 1, wherein said stopper is in a form of a pair of nuts (54) threaded on said screw (44) such that each of said nuts (54) applies a force on the other.

8. The caulking gun of claim 1, wherein said bearing is covered by a cover, for preventing the material dispensed by said tube from entering into rotating parts of said bearing.

9. The caulking gun of claim 1, wherein said housing further comprising a foldable handle, for preventing rotating of said caulking gun when being used.

* * * * *